United States Patent [19]

Barker

[11] Patent Number: 4,995,121

[45] Date of Patent: Feb. 26, 1991

[54] COMPACT BIDET ASSEMBLY WITH EXTERNAL ADJUSTMENT

[76] Inventor: Douglas J. Barker, 1280 Sunshine La., Southlake, Tex. 76092

[21] Appl. No.: 410,956

[22] Filed: Sep. 22, 1989

[51] Int. Cl.[5] ..... A47K 3/22; A47K 3/20; A61H 35/00

[52] U.S. Cl. ..... 4/443; 4/420.2; 4/420.4; 4/444; 4/447; 4/448

[58] Field of Search ..... 4/443–448, 4/420.1–420.5

[56] References Cited

U.S. PATENT DOCUMENTS

| | | | |
|---|---|---|---|
| 1,683,063 | 9/1928 | Campus | 4/420.5 |
| 1,838,356 | 12/1931 | Berry | 4/448 X |
| 1,960,839 | 5/1934 | Campus | 4/420.4 |
| 2,995,759 | 8/1961 | Gentry | 4/420.1 |
| 3,045,248 | 7/1962 | Gentry | 4/420.1 |
| 3,156,929 | 11/1964 | Davis, Jr. | 4/420.4 |
| 3,195,148 | 7/1965 | Merkel, Jr. | 4/447 |
| 3,425,066 | 2/1969 | Berger | 4/420.4 |
| 3,430,268 | 3/1969 | Zoberg | 4/447 |
| 3,925,826 | 12/1975 | Huyot et al. | 4/420.4 |
| 4,028,745 | 6/1977 | Caniglia | 4/420.2 |
| 4,041,553 | 8/1977 | Sussman | 4/447 |
| 4,237,560 | 12/1980 | Riegelman et al. | 4/447 |
| 4,441,219 | 4/1984 | Epstein | 4/448 |
| 4,617,688 | 10/1986 | Kuo | 4/420.2 |

*Primary Examiner*—Henry K. Artis

*Attorney, Agent, or Firm*—Hubbard, Thurman Turner, Tucker & Harris

[57] ABSTRACT

A compact bidet assembly having external adjustment is mounted to the rear undersurface of a seat of a conventional toilet. A body having a fixed element connected to a source of water by means of flexible tubing hidden under the seat has an adjacent rotatable element and internal passageway leading to a nozzle. The nozzle rotates in response to a hidden control rod having a handle extended just beyond the seat edge and aligned to indicate the directional position of the nozzle, the nozzle being rotatable in a vertical arc to about 15 degrees above horizontal (seat down) to at least 30 degrees below horizontal. A control valve assembly provides water preadjusted for temperature and pressure to the bidet assembly by off-on control with the initial surge of warmup water being diverted to the bowl under the seat. An alternate control valve assembly is provided to replace the sink faucet assembly one mode supplying water through a diverter valve to the bidet and another mode diverting water to the sink faucet.

8 Claims, 3 Drawing Sheets

10
40
86
104
94
90
88
18
82
36
34
98
92
84
46
96
100
38

100
96
10
34
106
104
90
18
82
38
88
98
86
92
84
40
46
36

64
78
76
62
50
60
74
70
72
52
68

COMPACT BIDET ASSEMBLY WITH EXTERNAL ADJUSTMENT

BACKGROUND OF THE INVENTION

1. Field of the Invention

This invention relates to bidet assemblies primarily intended for retrofit usage on a conventional toilet; more specifically, a compact bidet assembly operated by external means and mounted hidden from view on the undersurface of a toilet seat.

2. Background of the Prior Art

Bidets have not been widely accepted in the United States, in spite of the many benefits. Bidets provide enhanced cleanliness and avoid the use of toilet paper which is an increasing ecological concern. Individuals with hemorrhoids or other medical conditions or those recuperating from surgery find the bidet essential. There is increased marine use of bidets because of the clogging problem caused by the paper that is normally used.

A number of shortcomings are seen in the prior art bidet devices. Many of the devices have a fixed nozzle which leaves the user with no control over the application of cleansing water which given sufficient pressure can spray out onto the user's legs. Some devices provide a nozzle located some distance below the seat which requires reaching down into the bowl to obtain adjustment of the spray.

Those that have adjustable nozzles, such as Kuo, U.S. Pat. No. 4,617,688, Oct. 21, 1986 or Sussman, U.S. Pat. No. 4,041,553, Aug. 16, 1977, either have complicated adjustment mechanisms as in Kuo or undesirable bridging support structure which interferes with the operators washing motions, are crude and have a tendency to accumulate unsightly elimination materials.

The present invention solves the problems of unsightliness by providing a compact externally adjusted bidet assembly for unobtrusive attachment on the undersurface of a toilet seat hidden from view. The unit is constructed of only a few separate elements which are inexpensive and foolproof. Installation is the ultimate of simplicity. Water temperature can be adjusted comfortably before contacting the user.

SUMMARY OF THE INVENTION

An improved compact bidet assembly is provided for inobtrusive attachment to the seat portion of a conventional toilet to be used by a seated user for personal hygiene without otherwise significantly affecting appearance or use of the toilet. A conventional toilet seat has a generally planar undersurface with a generally oval-shaped seat portion squared off in the back and a generally oval-shaped central opening. A typical seat is hinged to the back of the bowl and supported on the rim of the bowl.

The present invention has a mounting spacer for attachment to the undersurface of the toilet seat adjacent the rearmost portion of the seat opening and a compact body having a fixed element and an adjacent rotatable element including means for sealing the rotable element from leakage and means for drawing and holding the fixed and rotable elements together in fluid tight engagement. The assembly includes means for rotatably fluid sealing the fixed element passageway.

The fixed element is rigidly fastened to the spacer plate and having a rearwardly facing fluid inlet leading to a first internal passageway, the rotatable element being rotatable in fluid tight connection with the fixed element, and having a forwardly facing fluid directing nozzle with a second internal fluid passageway leading to the fluid directing nozzle. The first and second internal passageways are connected in fluid communication and form a continuous fluid passageway from the inlet to said nozzle. The nozzle is rotatable with the rotatable element in response to a control rod which extends at right angles to a central axis of the nozzle and is rotatable with respect to the fixed element in an arc about 15 degrees above the horizontal plane of the underside of the seat positioned on the bowl to at least 30 degrees below said plane when the assembly is attached to the seat.

The control rod extends to at least the edge of the seat and has affixed thereto a small handle which is generally aligned with the central axis of the nozzle. It serves as an indicator of the nozzle position. Opposite the handle end of the control rod, the control rod includes a locking surface which engages a corresponding locking surface formed in a wall of the rotatable element and a means for sealing the rotatable element from leakage including means for drawing and holding the fixed and rotatable elements together in fluid tight engagement.

Where the control rod passes through the fixed element it includes a circular stepped shoulder portion and a sealing washer which is held between the stepped shoulder and a washer retaining circular lip surrounding the central axis of the fixed element. When drawn tight by a fastener means on the non-handle end of the control rod this structure serves as a bearing and seal means between the control rod and the fixed element. The fastener presses against a compressible washer element where the control rod exits the rotatable element to prevent leakage from the internal passageway.

A centrally located rearwardly facing fluid inlet is supplied with water at a repeatable comfortable temperature through a supply line. The supply line is fed by a valve body connected to hot and cold water supply lines and having hot and cold water control valves, a mixing chamber and an off-on control valve. The nozzle may be pointed downwardly in a vertical orientation with water being supplied from the control valve assembly without touching the user. The hot and cold control valves can be adjusted to a desired composite temperature and once adjusted can remain relatively unchanged. The off-on supply valve then controls the supply of water through the supply line.

A commercially available anti-siphon vacuum breaker to comply with building codes may be mounted in the supply line between the control valve assembly and the bidet assembly at an elevated position relative to the bidet assembly. This valve may conveniently be attached to the tank.

An alternative sink control valve assembly is provided to be installed in place of the conventional hot and cold water sink faucet. The hot and cold water can be mixed by adjustment of the hot and cold valves as is conventional and the sink may be used in the conventional manner. A switching valve is provided which transfers the output from the faucet to a separate supply line which is piped directly, or through a vacuum breaker, to the bidet. The bidet nozzle again may be directed downwardly until the temperature equalizes before being utilized. The switching valve is returned to the sink position after use.

Installation of the bidet assembly is easily accomplished with the use of a simple template to locate holes for two screws on the undersurface of the toilet seat. Two screws through the mounting spacer will secure the bidet assembly to the seat with approximately one-third of the short nozzle extending beyond the rear most portion of the seat opening in its most elevated position. When the nozzle is rotated downwardly to essentially a vertical position the bidet assembly is hidden from view from above.

BRIEF DESCRIPTION OF THE DRAWINGS

Other objects and features of the invention will become more readily apparent from the following detailed description when read in conjunction with the accompanying drawings, in which like reference numerals designate like parts throughout the figures thereof, and in which.

DESCRIPTION OF THE PREFERRED EMBODIMENT

Figures 1, 2, 3, 4:
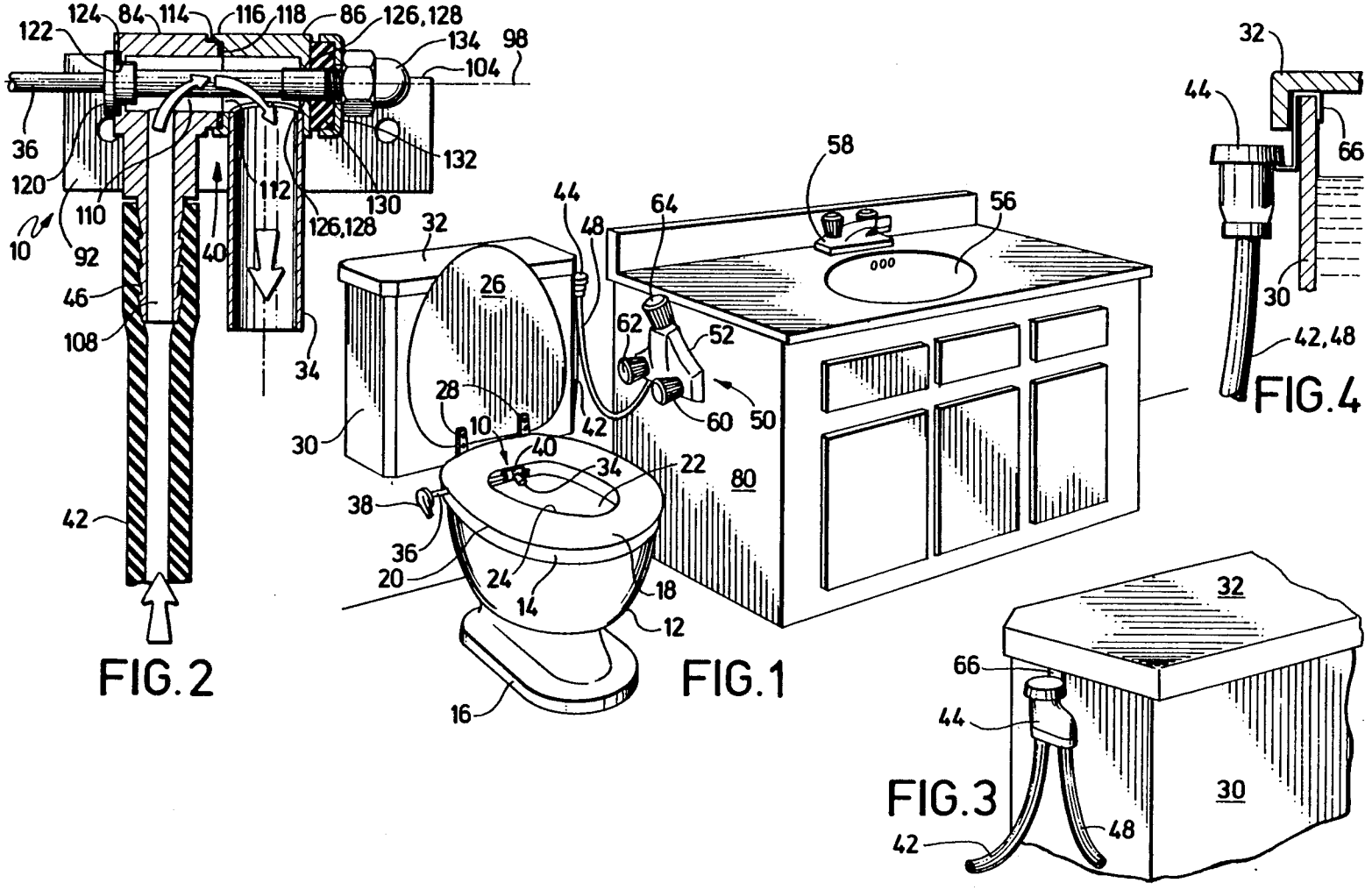
FIG. 1 is a perspective view showing the bidet assembly mounted on the underside of a toilet seat and supplied through a control valve assembly and vacuum breaker.
FIG. 2 is a cut-away view of the bidet assembly with the nozzle rotated 180 degrees from its normal position.
FIG. 3 is a perspective view showing a vacuum breaker mounted in the supply line.
FIG. 4 shows a mounting bracket to support the vacuum breaker on the side of a tank.

Throughout the description that follows like reference numerals will be used to indicate the same part. In FIG. 1 the bidet assembly is indicated generally as reference numeral 10. Toilet bowl 12 has rim 14 mounted on base 16. Oval seat 18 has outside edge 20 and centralized oval shaped opening 22. Opening 22 is defined by the inside edge 24 of seat 18. Seat 18 and lid 26 are mounted on hinges 28 in the usual manner. Behind lid 26 is tank 30 which is a reservoir for water to flush bowl 12. Tank 30 has lid 32.

Bidet assembly 10 has body 40, nozzle 34, control rod 36 and handle 38. Control rod 36 is seen extending in from beyond edge 20 of seat 18 to body 40. Body 40 is seen centered at the rearmost portion of opening 22 mounted under seat 18 in FIG. 1, FIG. 5 and FIG. 6. Bidet assembly 10 in greater detail is seen in FIG. 2.

Figure 5:
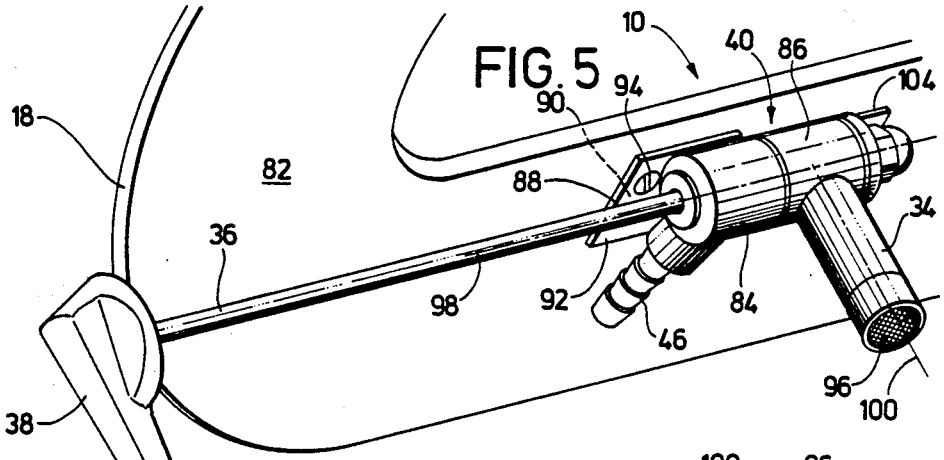
FIG. 5 is a perspective view of the bidet in mounted position on the undersurface of a toilet seat with the inlet pointed rearwardly and the nozzle directed downwardly.

Referring again to FIG. 1 is seen fluid supply line 42 depending from vacuum breaker 44. Supply line 42 passes down the side and around under the tank directly to the bidet assembly 10 under seat 18 where it is connected to barbed nipple 46 as indicated in FIGS. 2 and 5. Thus, supply line 42 is completely hidden from view with seat 18 in the user position indicated in FIG. 1. Supply line 48 is seen emanating from control valve assembly 50 leading to vacuum breaker 44. In the event building codes do not require vacuum breaker 44, supply line 42 may be connected directly to control valve assembly 50 also shown in FIG. 7.

Control valve assembly 50 has a body 52 conveniently mounted on a side of sink cabinet 54 also having sink 56 and conventional faucet assembly 58. Body 52 has cold water valve 60, hot water valve 62 and off-on control valve 64. In FIG. 3 control valve 44 with supply lines 42, 48 is seen suspended by bracket 66 from the edge of tank 30 under lid 32. In FIG. 4, bracket 66 is seen as a U-shaped bracket fitting over the edge of tank 30 under lid 32 to support vacuum breaker 44. The water contained in tank 30 is indicated by the dashed lines.

Figure 7:
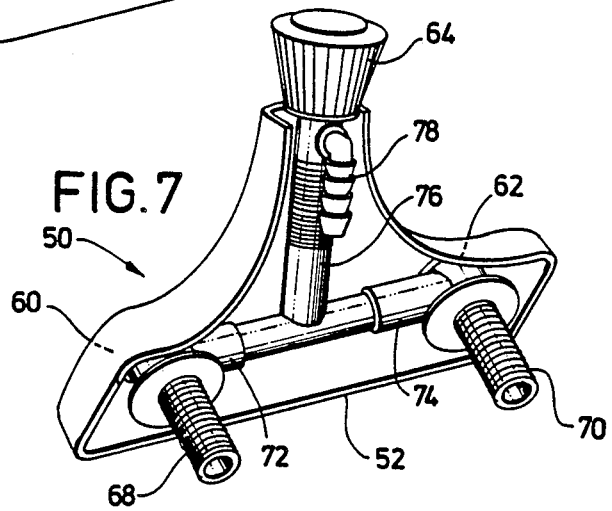
FIG. 7 is a perspective view of a control valve assembly illustrated in FIG. 1 showing the underside thereof.

In FIG. 7, control valve assembly 50 is shown in perspective from the underside, although cold water valve 60 and hot water valve 62 cannot actually be seen. A source of pressurized cold water is connected to cold water inlet 68 and a source of pressurized hot water is connected to hot water inlet 70. Controlled by cold water valve 60 the water from cold water inlet 68 passes through fitting 72 and the hot water from source 70 controlled by valve 62 passes through hot water fitting 74 to T-shaped mixing section 76 which is controlled by control valve 64 to permit the mixed hot and cold water to emanate from barbed outlet 78 which is connected to supply line 48 or directly to supply line 42. Control assembly 50 is conveniently mounted on the side 80 of cabinet 54 conveniently accessible to control of a user.

Figure 6:
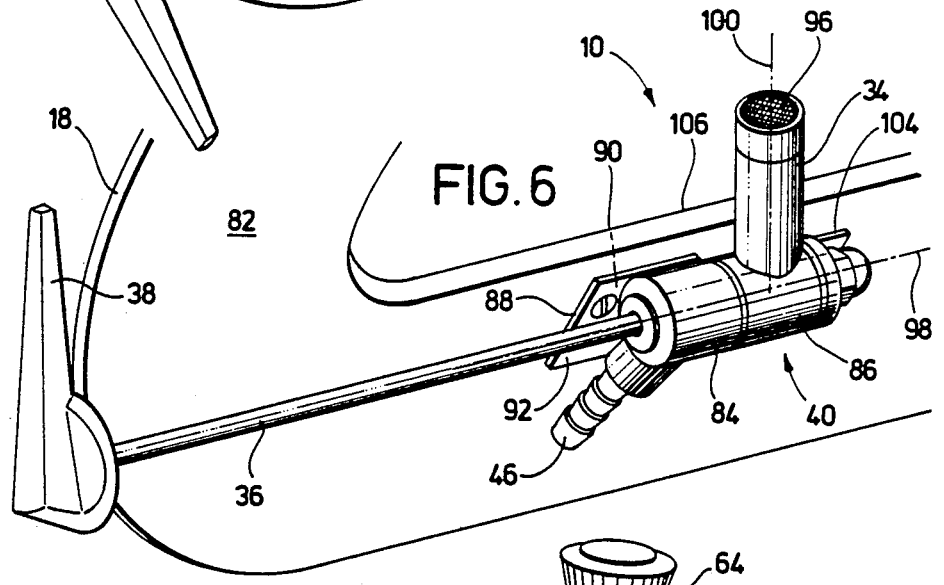
FIG. 6 is the device of FIG. 5 with the nozzle rotated to a position slightly above the plane of the undersurface of the seat.

In FIGS. 5 and 6 the bidet assembly 10 is seen mounted to the flat planar undersurface 82 of seat 18. Body 40 comprises a fixed element 84 and a rotatable element 86. Mounting spacer 88 is a mounting plate having flat planar mounting surface 90 and a spaced apart planar spacing surface 92. It is mounted to surface 82 by fasteners such as fastener 94. Fixed element 84 is fixed to a portion of spacing surface 92 of mounting spacer plate 88. Fixed element 84 has a rearwardly facing fluid inlet 46 facing directly to the rear of seat 18 as mounted in FIG. 5. Inlet 46 includes an externally barbed nipple suitable for receiving and holding plastic tubing.

Adjacent fixed element 84 is rotatable element 86 being rotatable in fluid tight connection with the fixed element and having a forwardly facing nozzle 34 in one position of rotation, nozzle 34 being fixed to rotatable element 86 in fluid communication with an internal passageway therein and rotatable with element 86 to an angle about 15 degrees above the plane of planar surface 82 (horizontal with seat down) rotatable in the plane of a vertical arc to a position at least 30 degrees below the planar surface 82 and usually to at least a vertical orientation. In fact the rotatable element is capable of at least 180 degree rotation but for the fact that the nozzle may come into contact with the rim or an interior portion of the bowl on which the seat is placed. This will depend upon the particular configuration of the conventional bowl. Nozzle 34 is shown having optional conventional aerator 96 in the end of the nozzle to provide a smooth non-splashing flow of water in operation. By this is meant the type of aerator often used at the outlet of a sink faucet. The nozzle 34 may optionally have an angulated end portion. The end may be angulated upward toward the seat opening about 15 degrees above axis 100 in FIG. 5.

Fixed element 84 and adjacent rotatable element 86 have a circular configuration and together with control rod 36 have a central axis 98 coincident with each other. Nozzle 34 has a central axis 100 which generally intersects the axis 98 at right angles. Rotatable element 86 receives support from fixed element 84 and is spaced above planar surface 82 for freedom of rotation. Mounting spacer 88 has a relieved edge portion 104 which serves as a stop for rotatable element 86 because it comes into contact with a portion of nozzle 34 in the position shown in FIG. 6 to prevent nozzle 34 from having its central axis raised more than about 15 degrees above the planar undersurface 82 of seat 18. It might also be noted that this may also be accomplished by choice of location of the mounting spacer 88 forwardly or backwardly of edge 106 defining the rear center of opening 22, the inside edge of seat 18. It is seen that the backwardly or rearwardly facing inlet 46 is connected under seat 18 to supply tube 42 which leads directly rearwardly under the seat and may be fastened under the tank essentially hidden from view. This supply tube is flexible to permit raising the seat 18.

Referring now to FIG. 2 is seen a cut-away view of the bidet assembly 10 showing fixed element 84 adjacent rotatable element 86 mounted together with control rod 36. Elements 84, 86, have a central axis which coincides with central axis 98 of control rod 36. Fixed element 84 has fluid inlet 46 protruding therefrom having inlet passage 108. Inlet 46 and its internal passage 108 lead to first passageway 110 in fixed element 84 in fluid communication with internal passageway 112 of rotatable 86 as indicated by the arrows showing flow of the fluid from the inlet to the nozzle. In FIG. 2 the nozzle has been rotated opposite its normal direction for convenience in fitting the structure on the drawing sheet.

Element 84 has a circular recess 114 and rotatable element 86 has a circular shoulder 116 which offer mutual support. Together they contain a plastic sealing washer 118 which seals elements 84, 86 and offers reduced friction for relative rotation of the rotatable element with respect to the fixed element. Fixed element 84 is mounted to spacing surface 92. Control rod 36 has a circular stepped shoulder portion 120 which is fitted against the side of fixed element 84. Element 84 has a washer retaining circular lip 122 which together with stepped shoulder 120 hold a plastic sealing washer 124 which serves to prevent external leakage from first passageway 110 and provides a reduced friction bearing support for control rod 36.

Control rod 36 passes through elements 84, 86 having a distal end which extends through a sidewall of rotatable element 86. The sidewall of element 86 has locking surfaces 126 and the end portion of rod 36 has a corresponding locking surfaces 128 which may take the form of flattened areas of rod 36 which feed into a correspondingly shaped area in the sidewall of element 86. This provides the locking mechanism whereby rotation of control rod 36 will rotate element 86. A means for sealing the rotatable element from leakage comprises a compressable washer 130 with a flat surface thereof resting against the sidewall of element 86 and surrounding a portion of rod 36. Washer 130 is covered by a cap member 132 and the threaded end of rod 36 has a nut 134 which when connected thereto serves as a means for drawing and holding the fixed and rotatable elements together in fluid tight engagement. It will be seen that drawing the nut 134 snuggly against the cap 132 resting on compressable washer 130 draws the stepped shoulder 120 against the washer at the sidewall of fixed element 84 which constitutes a means for rotatably fluid sealing the passageway in the fixed element. It also pulls the two elements together against sealing washer 118.

Figure 8:
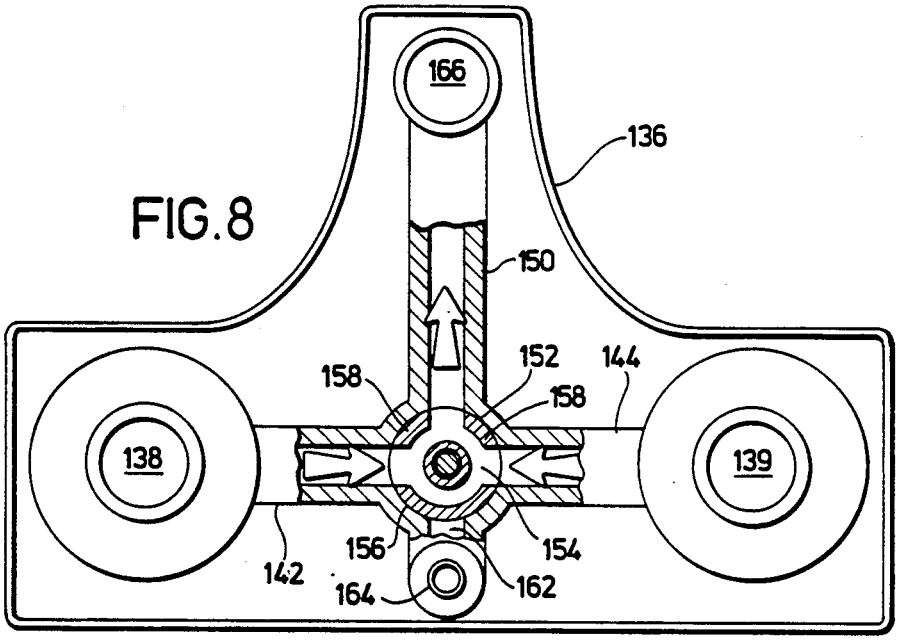
FIG. 8 is a bottom plane view of a modified sink control valve assembly set for normal sink faucet usage.
Figure 9:
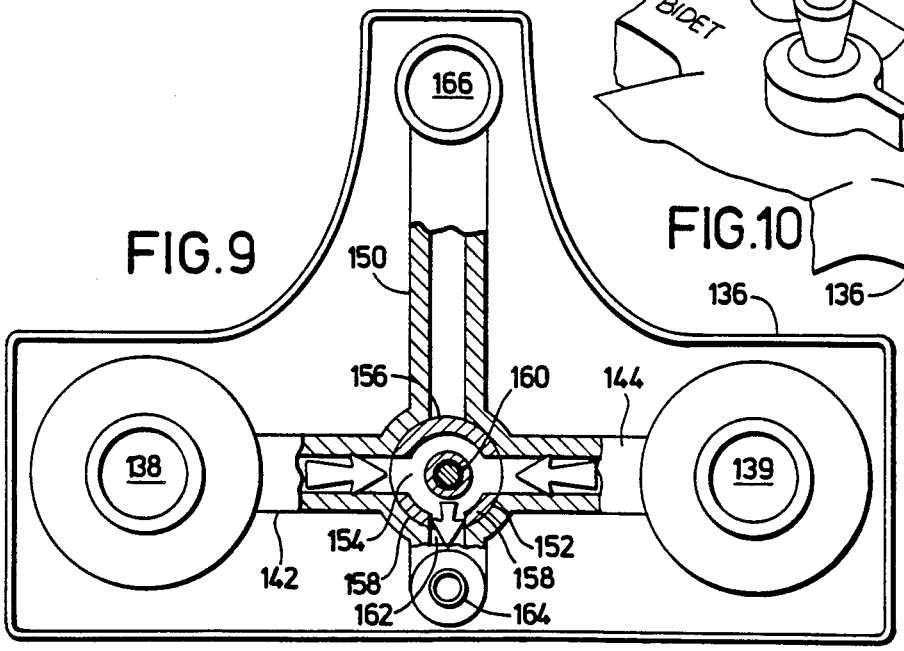
FIG. 9 is the sink control valve assembly of FIG. 8 with the control valve set to divert water to the bidet supply line.
Figure 10:
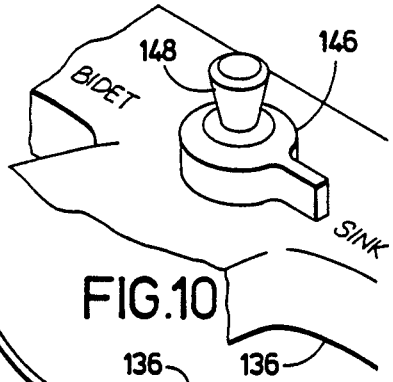
FIG. 10 is a perspective view of the sink control valve assembly of FIGS. 8 and 9 set for the sink position of FIG. 8.

An alternate source of controllable hot and cold water as seen in FIGS. 8–10. This is a specially designed faucet assembly that would replace faucet assembly 58 in FIG. 1. Mounted in body 136 is hot water inlet 138 and cold water inlet 139. Hot water passage 142 and cold water passage 144 lead to diverter valve 146. Centered reciprocably in diverter valve 146 is stem 148. Centered in diverter valve 146 is a downwardly extending portion 160 which serves to operate a conventional drain in sink 56. Diverter valve 146 is rotatable to a sink position or a bidet position as indicated in FIG. 10.

Referring now to FIGS. 8 and 9. Passages 142 and 144 together with faucet outlet passage 150 meet at a cylindrical-shaped hollow portion 152 containing a cylindrical-shaped channel ball element 154 which has a blocking portion 156 and two separated diverter portions 158 opposite blocking portion 156 on ball element 154. Ball element 154 has a rod 160 passing therethrough connected to stem 148 for operation of a conventional drain. It must be secured by appropriate 0 rings to prevent leakage. Ball element 154 is rotationally connected to diverter valve 146 for rotation therewith and may be held in place with a conventional cap and sealing washer to prevent leakage.

With the diverter valve 146 rotated as in FIG. 10 diverter portions 158 are rotated adjacent faucet outlet passage 150 so that the faucet may be utilized conventionally. Blocking element 156 covers passage 162 leading to bidet outlet 164. Hot and cold water are adjusted and pass in a direction of the arrows to faucet opening 166 and the faucet may thus be used in the conventional manner.

With the diverter valve 146 rotated to the bidet position the channel ball element 154 is rotated 180 degrees so that the blocking portion 156 now blocks faucet outlet passage 150 and the diverter portions 158 are rotated adjacent passage 162 leading to bidet outlet 164 which may be a barbed nipple as was indicated previously. Now water may be adjusted by the hot and cold valves and passes in the direction of the arrows indicated in FIG. 9 to the bidet outlet which is connected to the supply line 42, 48, leading to the bidet.

In operation the device of FIGS. 8–10 allows a conventional sink to be utilized with a conventional looking faucet assembly having a dual purpose. With the diverter valve in the sink position the faucet is operated conventionally. The hot and cold valves can be adjusted to produce a suitable mixed water temperature coming out of faucet 166 at an appropriate volume. Once the temperature is stabilized the diverter 146 is placed in the bidet position which diverts the now adjusted water to bidet assembly 10 mounted on the undersurface of the toilet seat. This operation is performed with the fluid directing nozzle pointed directly down into the bowl to avoid splashing. Splashing is further avoided by the use of the optional aerator in nozzle 34. There is no possibility of fluid being sprayed out beyond the toilet bowl because the nozzle is directed downwardly into the bowl. Now the user sits on the unit and by means of handle 38 rotates the bidet assembly to the appropriate position for use and when finished with the washing operation, rotates the handle downwardly to rotate the fluid directing nozzle 34 back down into the bowl. The diverter valve is then returned to the sink position which cuts off further liquid flow to the bidet assembly.

The control valve assembly 50 operates in a similar manner except that it has the advantage of being separate from the faucet assembly 58 and is operable by the user while seated on the toilet seat. The water valves 60, 62 are adjusted to produce a comfortable water temperature at the bidet outlet which is pointed downwardly as before. After the temperature is stabilized, control valves 60, 62 may be left as is and the unit operated by off-on valve 64. Subsequently it is only necessary to make sure the bidet assembly is pointed downward and off-on valve 64 is opened to allow the temperature to equalize before using the device.

The sealing washers 124, 118 are preferably resin impregnated composition washers which are resistant to swelling or disintegration when exposed to water. They have only slight compressability although plastic or teflon washers are suitably used. The compressible washer 130 is preferably a flexible rubber washer. The supply tube 42, 48 is preferably a flexible plastic tubing suitable for installation over a barbed nipple as shown in FIG. 2. It is readily installed without special tools. Tubing designed for medical or laboratory use, such as Tygon brand tubing is entirely suitable. The opening in inlet 46 of fixed member 84 is conveniently about ¼ of an inch in diameter and similar barb nipples can be used elsewhere, as for example barb outlet 78. This sized opening will permit a maximum flow through the bidet assembly of about 3 gallons per minute under normal household water pressure and the flow can be reduced by operation of the control valves as desired.

Control valve assembly 50 could more inconspicuously be plumbed to the wall of the bathroom adjacent the toilet tank, as between the tank 30 and the sink cabinet 54. Due to the inconspicuous nature of the flexible supply tubing and the fact that it runs directly behind and under the toilet seat in the direction of the tank, the water can be supplied in an inconspicuous manner with the supply tube largely hidden. This is particularly so if the alternate sink faucet diverter valve unit as utilized wherein the supply tube can be passed through an opening in sidewall 80 at the floor level and runup under the tank unit to connect to the bidet assembly 10. If the anti-siphon vacuum breaker 44 is required it can be located back against the wall at the top edge of the tank. In order to perform its function it must be elevated with respect to the bidet 10 not less than 6 inches. It prevents any possibility of contaminated water being siphoned from an overfilled water bowl into the potable water supply. The bidet 10 itself is conveniently made from metals which are suitable for brazing or soldering.

Although, only a single embodiment of this invention has been described, it will be apparent to a person skilled in the art that various modifications to the details of construction shown and described may be made without departing from the scope of this invention.

What is claimed is:

1. An improved compact bidet assembly for inobtrusive attachment to the seat portion of a conventional toilet to be used by a seated user for personal hygiene without otherwise significantly affecting appearance or use of the toilet, comprising a mounting spacer for attachment to the undersurface of a toilet seat adjacent the rearmost portion of the seat opening; a fixed element having a fluid inlet mounted on a portion of the mounting spacer; a rotatable element in fluid tight connection with the fixed element, having a fluid directing nozzle being rotatable with the rotatable element in response to a control rod extending from a portion of the rotatable element to at least the outer edge of the seat; a passageway in fluid communication between the fluid inlet and the fluid directing nozzle;

said mounting spacer having a flat mounting surface and a spacing surface, the fixed element being mounted on the spacing surface and providing support for the rotatable element, the rotatable element being spaced apart from the undersurface of the seat when the mounting spacer is positioned on the seat and mounted for use;

said control rod having a central axis which coincides with a central axis of the fixed element and a central axis of the rotatable element, wherein the control rod passes through the fixed element and the rotatable element and includes means for rotatably fluid sealing the passageway in the fixed element; the control rod further including a locking surface which engages a corresponding locking surface formed in a wall of the rotatable element, a means for sealing the rotatable element from leakage and, means for drawing and holding the fixed and rotatable elements together in fluid tight engagement.

2. The assembly of claim 1 wherein the means for rotatably fluid sealing the fixed element passageway comprises a circular stepped shoulder portion on the control rod and a sealing washer which is held between the stepped shoulder and washer retaining circular lip surrounding the central axis of the fixed element.

3. The assembly of claim 1 wherein the means for sealing the rotatable element from leakage comprises a compressible washer element surrounding the portion of said control rod which passes through the rotatable element and the means for drawing and holding the fixed and rotatable elements together in fluid tight engagement comprises a threaded end of the control rod and a corresponding fastener which compresses said washer element when threaded on said rod.

4. The assembly of claim 2 wherein the means for sealing the rotatable element from leakage comprises a compressible washer element surrounding the portion of said control rod which passes through the rotatable element and the means for drawing and holding the fixed and rotatable elements together in fluid tight engagement comprises a threaded end of the control rod and a corresponding fastener which compresses said washer element when threaded on said rod.

5. An unobtrusive compact bidet assembly for attachment to the seat portion of a conventional toilet without significantly affecting appearance or normal use of the toilet, in operable combination, comprising a mounting spacer plate for attachment to the undersurface of a toilet seat adjacent the rearmost portion of the seat opening, said spacer plate having a planar mounting surface and a planar spacing surface separated therefrom; a compact body having a fixed element and an adjacent rotatable element; the fixed element being rigidly fastened to the spacer plate and having a rearwardly facing fluid inlet leading to a first internal passageway; the rotatable element being rotatable in fluid tight connection with the fixed element, having a forwardly facing fluid directing nozzle with a second internal fluid passageway in fluid communication with the first internal passageway; said second fluid passageway leading to said nozzle; said nozzle being rotatable with said rotatable element in response to a control rod having a central axis extending at right angles to a central axis of said nozzle, the control rod having a central axis coinciding with a central axis of the fixed and a central axis of the rotatable elements;

the control rod passing through the rotatable element and including means for fluid sealing the passageway in the rotatable element from external leakage, the control rod further including a locking surface which engages a corresponding locking surface formed in a wall of the rotatable element;

the nozzle being rotatable in an arc about 15 degrees above the plane of the seat to at least about 30 degrees below said plane when the assembly is attached to the seat;

6. The assembly of claim 5 wherein the means for sealing the rotatable element from leakage comprises a compressible washer element surrounding the portion of said control rod which passes through the rotatable element.

7. The assembly of claim 6 further including means for drawing and holding the fixed and rotatable elements together in fluid tight engagement comprising, a threaded end of the control rod and a corresponding fastener, which compresses said washer element when threaded on said rod.

8. An unobtrusive compact bidet assembly for attachment to the seat portion of a conventional toilet without significantly affecting appearance or normal use of the toilet, in operable combination, comprising a mounting spacer plate for attachment to the undersurface of a toilet seat adjacent the rearmost portion of the seat opening, said spacer plate having a planar mounting surface and a planar spacing surface separated therefrom; a compact body having a fixed element and an adjacent rotatable element; the fixed element being rigidly fastened to the spacer plate and having a rearwardly facing fluid inlet leading to a first internal passageway; the rotatable element being rotatable in fluid tight connection with the fixed element, having a forwardly facing fluid directing nozzle with a second internal fluid passageway in fluid communication with the first internal passageway; said second fluid passageway leading to said nozzle; said nozzle being rotatable with said rotatable element in response to a control rod having a central axis extending at right angles to a central axis of aid nozzle;

the control rod passing through the fixed element and the rotatable element;

the control rod having a central axis coinciding with a central axis of the fixed and rotatable elements, and includes means for rotatably fluid sealing the passageway in the fixed element, the control rod further including a locking surface which engages a corresponding locking surface formed in a wall of the rotatable element; a means for sealing the rotatable element from leakage; and, means for drawing and holding the fixed and rotatable elements together in fluid tight engagement.

* * * * *